US006677573B1

(12) United States Patent
Nakata et al.

(10) Patent No.: US 6,677,573 B1
(45) Date of Patent: Jan. 13, 2004

(54) LASER SENSOR HAVING A PINHOLE FOR PARTICLE MEASUREMENT

(75) Inventors: Naotaro Nakata, Kyoto (JP); Hironori Endo, Nagano (JP)

(73) Assignees: Rohm Co., Ltd., Kyoto (JP); Seiko Epson Corporation, Tokyo (JP)

( * ) Notice: Subject to any disclaimer, the term of this patent is extended or adjusted under 35 U.S.C. 154(b) by 255 days.

(21) Appl. No.: 09/671,652

(22) Filed: Sep. 28, 2000

(30) Foreign Application Priority Data

Sep. 29, 1999 (JP) ..... 11/276901

(51) Int. Cl.[7] ..... H01J 5/16
(52) U.S. Cl. ..... 250/216; 356/336
(58) Field of Search ..... 250/216, 237 R, 250/574; 359/738–740; 356/336–343

(56) References Cited

U.S. PATENT DOCUMENTS 4,730,931 A * 3/1988 Watson ..... 356/429
4,852,985 A * 8/1989 Fujihara et al. ..... 359/387
5,748,311 A * 5/1998 Hamann et al. ..... 250/574
5,883,745 A * 3/1999 Kelley ..... 359/618
6,294,778 B1 * 9/2001 Cappiello ..... 250/216

* cited by examiner

*Primary Examiner*—Thanh X. Luu
(74) *Attorney, Agent, or Firm*—Arent Fox Kintner Plotkin & Kahn

(57) ABSTRACT

The laser sensor comprises: a laser source (1), a condenser lens (2) for converging the light from the laser source, and a pin hole plate (3) disposed adjacent to the condenser lens in the opposite side to the laser source, so that its pin hole (3*a*) is in the converging beam converged by the condenser lens. A light detecting portion is disposed at a converging portion of the light so as to face to the light beam passed the pin hole. The diameter of the pin hole is 0.4 to 0.7 mm. As a result, a small diameter beam having a constant diameter over a long section, which is longer than 100 mm, is obtained, so that the laser sensor can be used, irrespective to a small change of the detecting position. Further, the laser sensor allows to use a plastics lens as the condenser lens.

8 Claims, 8 Drawing Sheets

LASER SENSOR HAVING A PINHOLE FOR PARTICLE MEASUREMENT

FILED OF THE INVNETION

The present invention relates to a laser sensor for detecting and counting flying particles or drops, using a small diameter laser beam, such as a sensor for detecting ink drops in an ink jet type printer. More particularly, the present invention relates to a laser sensor using a laser beam, which has a substantially constant beam diameter in a long detecting section, so that a stable detection can be realized.

BACKGROUND OF THE INVENTION

Such a sensor for detecting, for example, ink drops, comprises a laser source, a condenser lens and a light detecting portion. The laser source and the light detecting portion are arranged so that they face to each other. The laser beam is narrowed by the condenser lens to be a small diameter beam. When a particle enters into an area of the narrow beam, the laser beam is intercepted, therefore the particle can be detected according to the change of the light quantity received by the light detecting portion. In general, the particles, which will pass the laser beam have a diameter of about some ten micro meters, and it is preferable that the laser beam is narrowed to be less than 10 times of the diameter of the particles. Further, a long diameter narrowed section of the laser beam is desirable for securing a long detection section in an ink jet type printer so that particles can be detected, irrespective to the change of the position of an ink jet cartridge in an ink jet type printer due to the attaching allowance. In the prior art, three types of laser beam narrowing methods are used: (1) Parallel beam method; (2) Parallel beam and pin hole method; and (3) Converging beam method.

(1) Parallel beam method: The laser beam from a generator, such as gas laser, is used as is generated. The diameter of a laser beam emitting from a gas laser generator can be made small, by making the length of the gas laser resonator shorter. When the diameter of a laser beam is small, however, the diversity of the laser beam increases, as shown in FIG. 13, which shows the relation between the beam diameter at a distance of 100 mm from the laser generator and the beam diameter at the outlet of the laser generator. Therefore, there is a limitation to obtain a small diameter laser beam at a far distance from the laser source.

(2) Parallel beam and pin hole method: The optical system composed of a combination of a parallel beam and a pin hole is as follows; the laser source is disposed at a focus point of a condenser lens, and the parallel beam from the condenser lens is used, and a pin hole having a desired beam diameter is disposed in the back side of the lens. By decreasing the diameter of the pin hole, the diameter of the laser beam can be decreased. However, when the pin hole diameter is less than a certain value depending on the laser wave length, the diameter of the laser beam increases rapidly, due to the diffraction effect as FIG. 14 shows the relation between the beam diameter at a distance of 100 mm from the lens and the pin hole diameter. Therefore, it is difficult to obtain a small diameter laser beam having a constant beam diameter over a long section, which is longer than a certain distance.

(3) Converging beam method: In this method, the diameter of the laser beam is narrowed by means of a lens. According to this method, it is possible to obtain a minimum diameter spot, which is given by the expression $d=1.22\ \lambda/NA$. Therefore, the diameter of the laser beam can be decreased to an order of the laser wave length ($\lambda$) by increasing the numerical aperture NA of the lens. According to this method, however, the beam diameter rapidly increases when it exceeds the depth of focus$=\lambda/(NA)^2$. Namely, the beam diameter greatly varies depending on the distance from the lens, as shown in FIG. 15, which shows the relation between the beam diameter and the distance from the lens. Therefore, when such a sensor is used as a particle sensor, it is very difficult to determine a reference light detection level for deciding whether a particle is detected or not.

According to any of the aforementioned prior arts, it is impossible to obtain a small diameter laser beam, having a constant diameter over a long section, which is longer than 100 mm, for example. Therefore, it is recognized as a problem that it is difficult to judge whether a constant quantity of ink drops is supplied, using a constant diameter of laser beam, when a small change of the ink dropping position occurs by the exchange of an ink cartridge exchange.

Furthermore, according to any of the aforementioned prior arts, the beam converging point, namely the focusing point, depends strongly on the focal length of the condenser lens. Thus a lens made from a material, the refraction index of which depends strongly on the temperature, such as plastics, can not be used. And the lens must be made from a material, the refraction index of which hardly depends on the temperature, such as glass. In such an optical system, an aspherical lens is used, however, a glass aspherical lens is hard to fabricate commercially. Thus the cost of such a sensor is very expensive.

SUMMARY OF THE INVENTION

An object of the present invention is to solve those problems in such sensors in the prior art, providing a laser sensor enabling to obtain a small diameter laser beam, having a constant diameter over a long section, which is longer than 100 mm, for example, irrespective to a small change of the detecting position.

Another object of the present invention is to provide a laser sensor, which allows to use a plastics aspherical lens which also enables that the narrowed beam converging position hardly changes even when the focal length of the condenser lens changes a little.

The inventor of the present invention made repeated reviews in order to realize a laser sensor which can maintain a small and constant beam diameter over a long section longer than about 100 mm as mentioned above. As a result, it is found that a smaller diameter beam having a constant beam diameter over a long section over a certain distance can be obtained by a condenser lens converging a laser beam and disposing a pin hole, which has a rather large diameter in the converging beam passes at the condenser lens side of the converging beam. A conventional pin hole is disposed at the converging point of converging beam, or, as shown in the above-mentioned (2), is disposed in a parallel beam such that it passes through all or a part of the parallel beam. On the other hand, in the present invention, the light is converged by a condenser lens, and a rather large diameter pin hole is disposed in the converging light beam, so that a small diameter beam having a constant diameter over a section of certain length can be obtained. The inventor further studied and found that there is an appropriate range with respect to the position of the pin hole plate, the distance between the converging point of the condenser lens and the condenser lens and that, by optimizing them, a further smaller diameter beam having a constant beam diameter over a longer section can be obtained.

The laser sensor, according to the present invention comprises: a laser source; a condenser lens for converging the light from the laser source; a pin hole plate disposed adjacent to the condenser lens in the opposite side to the laser source, the pin hole plate having a pin hole positioned in the converging beam converged by the condenser lens; and a light detecting portion disposed so as to face to the converging beam passed the pin hole, wherein the diameter of the pin hole is formed to be 0.4 to 0.7 mm.

The expression adjacent to the condenser lens does not mean adjacent to the converging point (image point) of the converging beam, but means adjacent to the condenser lens or contact with the condenser lens, and it is preferable to have it nearer to the condenser lens. The term pin hole means a small hole disposed in a portion of a light blocking plate so as to pass a light therethrough.

Employing such configuration, it becomes possible to maintain the diameter of a small diameter beam to be constant over a long section and to realize a laser sensor which allows to detect particles exactly, even when the longitudinal position of the particles along the light beam can not be completely determined. The reason why the small diameter beam can be maintained over a long section is quite likely that the diameter of the light beam is determined according to the diffraction effect of a pin hole provided in the converging beam, which is disposed at a point adjacent to the condenser lens at the back side of the condenser lens.

It is preferable that the pin hole plate is disposed at the back side of the condenser lens, and the distance between the pin hole plate and the back face of the condenser lens is less than ⅕ of the distance s" between the image point of the laser source by the condenser lens and the second principal point of the condenser lens.

It is preferable that the position of the laser source and the focal length of the condenser lens are designed so that the distance s" between the image point of the laser source by the condenser lens and the second principal point of the condenser lens is larger than a certain required distance $\Delta z_0$, in which the predetermined beam diameter is maintained. Here, certain required distance, in which the predetermined beam diameter is maintained, means a length of a section in which the flying particles shall be detected, and the diameter of the light beam shall be constant. The necessary length of the section depends on each of the applications.

A condenser lens comprised of a plastics aspherical lens is preferable, because such a lens is easy to fabricate and the fabrication cost can be reduced. It allows to obtain a small diameter light beam having a constant diameter over a long section, by disposing a suitable pin hole plate to such a plastics aspherical lens.

DETAILED DESCRIPTION

Figure 1:
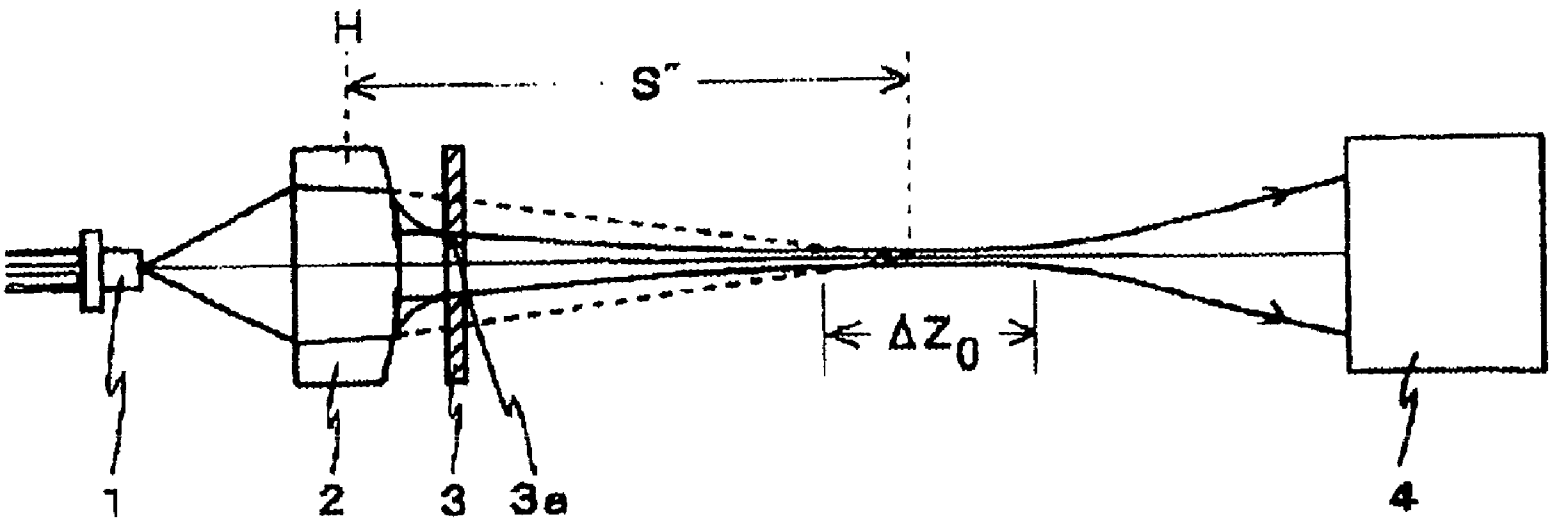
FIG. 1 is a schematic view of an embodiment of the laser sensor according to the present invention.

The laser sensor according to the present invention, as shown in FIG. 1 illustrating the constitution of an embodiment thereof, comprises: a laser source 1; a condenser lens 2 for converging the light from the laser source 1; a pin hole plate 3, which is disposed at a position near to the condenser lens 2 in the back side of the condenser lens 2 (opposite side to the laser source 1), such that its pin hole 3*a* is positioned in the converging beam converged by the condenser lens 2, and a light detecting portion 4 disposed at the back side of the converging point of the beam. The light detecting portion 4 is disposed so as to face to the light beam converged by the condenser lens 2, which passed the pin hole 3*a*. The diameter of the pin hole 3*a* formed in the pin hole plate 3 is formed to be 0.4 to 0.7 mm.

The laser source 1 may be a semiconductor laser, such as a laser diode (LD), or a gas laser, such as a He-Ne laser. With respect to the wave length of the laser source 1, there is no special requirement, although with respect to the light detecting element, which will be explained hereinafter, light detecting element mede of silicon is preferable, and when such a light detecting element mede of silicon is used, it is preferable to use a laser having a wave length less than 800 nm. In the discussion hereinafter, a semiconductor laser having a wavelength of 655 nm is used. The light detecting portion 4 comprises a condenser lens for converging the diverging light, and a light detecting element. The condenser lens is comprised of an aspherical lens. And a silicon semiconductor element, such as a photodiode or phototransistor, can be used as the light detecting element.

The condenser lens 2 is a combination of, for example, glass lenses, and is formed to be an aspherical lens having a diameter of, for example, 3 to 10 mm. In the discussions hereinafter, a condenser lens having a focal length of 10 mm is used. And the laser source 1 is disposed in the front side of the condenser lens 2 so that the light converges in the backside of the condenser lens.

The pin hole plate 3 is made from, for example, stainless steel, and has a thickness of 0.01 to 1 mm. A variety of pin hole plate having a pin hole 3*a* of different diameters are prepared. The pin hole plate 3 is arranged in the back side of the condenser lens 2 so that the pin hole 3*a* is aligned with the center of the condenser lens 2.

As mentioned before, the inventor repeatedly studied to obtain a laser sensor, which can provide a small diameter beam having a constant beam diameter over a long section, and is suitable for detecting flying particles. And it is found that a small diameter light beam having a constant diameter in a long section can be obtained, when the light from a laser source is converged by a condenser lens, and a pin hole of a predetermined diameter is disposed in the converging light beam, at a position near to the condenser lens in the back side of the condenser lens.

Figure 2:
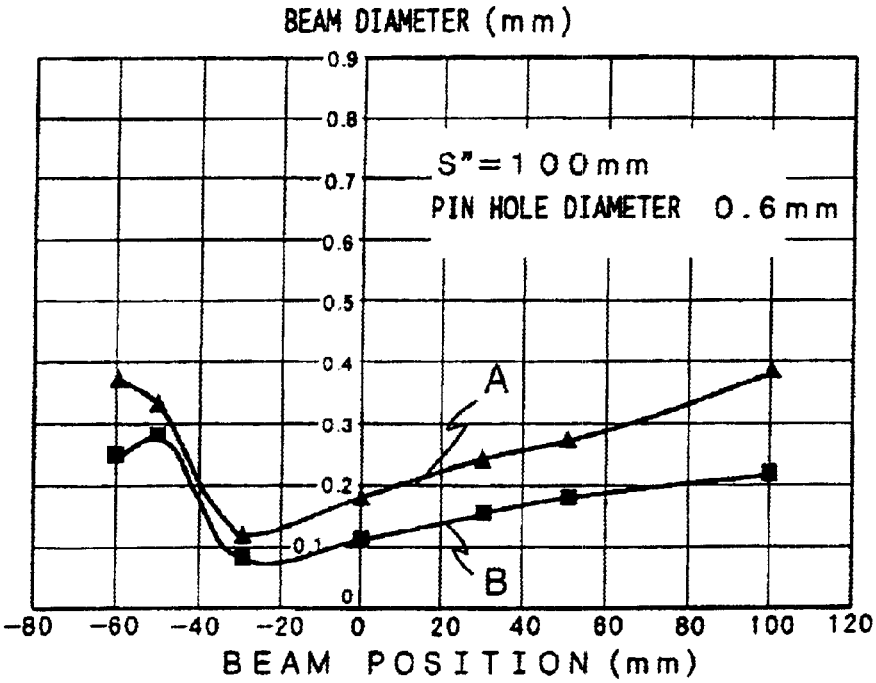
FIG. 2 is a graph showing the beam diameter as a function of the beam position, measured in the laser sensor of FIG. 1, under the conditions that s"=100 mm and that the pin hole diameter is 0.6 mm.

That is, as mentioned above, a semiconductor laser having a wave length of 655 nm is used as a laser source 1. A collimator lens 2 having a focal length of 10 mm is used as a condenser lens. The laser source 1 and the condenser lens 2 are arranged so that the image of the light source is formed in the position distant 100 mm from the lens in the back side of the condenser lens, (more exactly, distant from the second principal point of the condenser lens). Pin hole plates 3, having a thickness of 0.5 mm and having a different diameter pin hole, are subsequently disposed at a position distant 0.5 mm from the condenser lens in the back side of the condenser lens. The diameter of the pin holes varies from 0.3 mm to 0.8 mm with a step of 0.1 mm. Then, the beam diameter is measured by a beam profiler, which is an apparatus for measuring the diameter of a light beam. Two kind of beam diameters are defined and measured: 13.5% intensity beam diameter A is defined by the diameter, where the light intensity is 13.5% compared to the 100% intensity at the center portion of the beam; and 50% intensity beam diameter B is defined by the diameter, where the light intensity is 50% compared to the 100% intensity of the center portion of the beam. FIG. 2 is a graph showing the data for a pin hole, having a diameter of 0.6 mm. In the abscissa of FIG. 2, the point indicated by 0 is a position in a distance of 100 mm from the lens, where the image of the laser source shall be formed when no pin hole is disposed. The direction from the point 0 to the condenser lens is defined to be negative (−), and the direction is far away from the condenser lens is defined to be positive (+).

Figure 3:
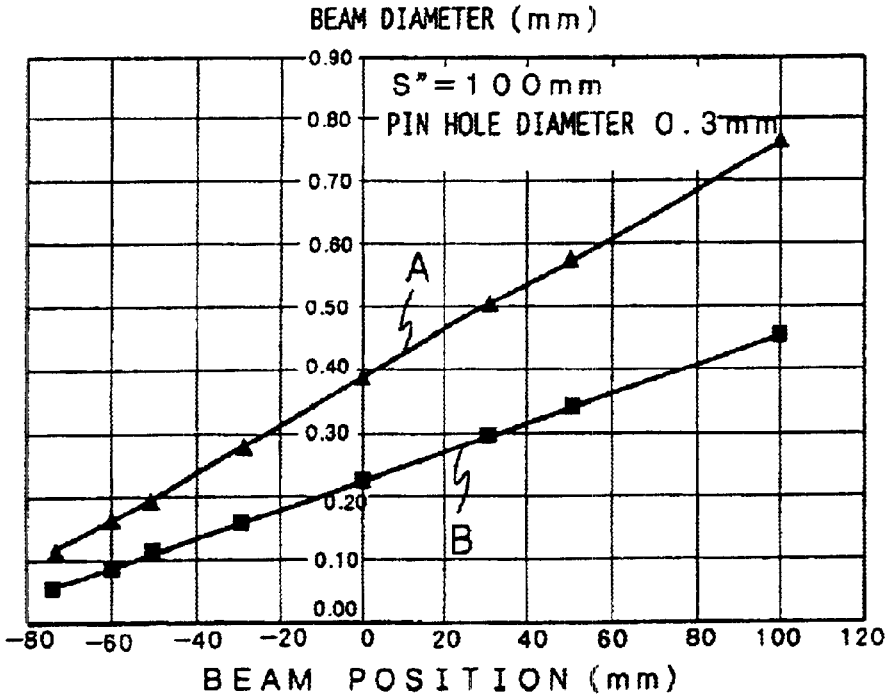
FIG. 3 is a graph showing the beam diameter as a function of the beam position, measured in the laser sensor of FIG. 1, under the conditions that s"=100 mm and that the pin hole diameter is 0.3 mm.
Figure 4:
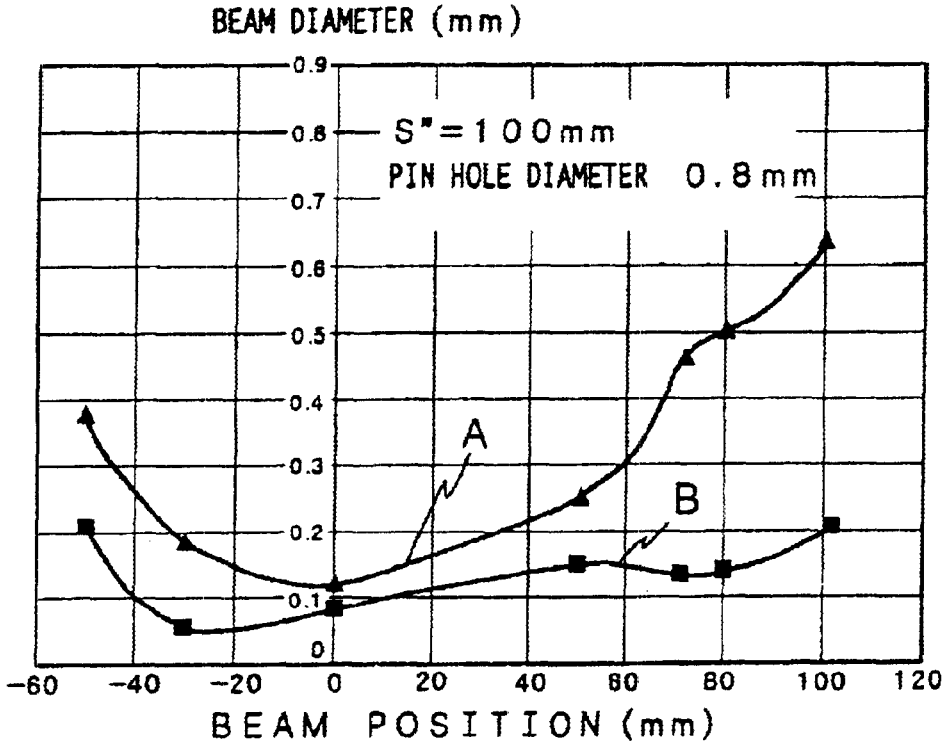
FIG. 4 is a graph showing the beam diameter as a function of the beam position, measured in the laser sensor of FIG. 1, under the conditions that s"=100 mm and that the pin hole diameter is 0.8 mm.
Figure 5:
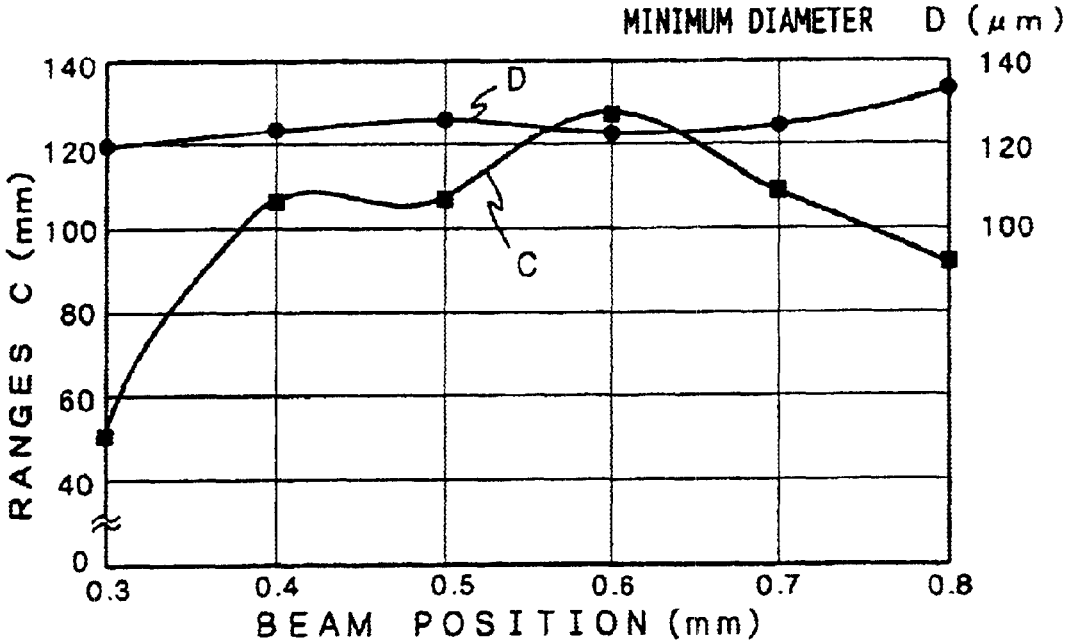
FIG. 5 is a graph showing the distance of the beam required for increasing the beam diameter up to three time of the initial beam diameter as a function of the pin hole diameter, measured in the laser sensor of FIG. 1.

Similarly, FIGS. 3 and 4 are graphs showing the data for the 13.5% intensity beam diameters A and the 50% intensity beam diameter B for pin holes having diameter of 0.3 mm and 0.8 mm. These six set of data are analyzed to find a range, where the 13.5% intensity beam diameter A increase to the three times of its minimum value, which is a diameter within a desired value. Such ranges are plotted in FIG. 5 as a function of the pin hole diameter. They are indicated by a reference C in FIG. 5. FIG. 5 shows that the range extends over 100 mm, when the pin hole diameter is between 0.4 to 0.7 mm. On the other hand, the range rapidly decreases smaller than 100 mm, when the pin hole diameter is 0.3 mm and 0.8 mm. In FIG. 5, also the minimum diameter D, defined in terms of 13.5% intensity beam diameter A, are plotted for each of the pin hole diameters. FIG. 5 shows that all of the minimum diameters are within 120 to 130 micro meters; namely a small diameter beam is obtained, irrespective to the pin hole diameters. It is apparent from FIG. 5 that a small diameter beam can be obtained over a long section, when the pin hole diameter is 0.4 to 0.7 mm.

Figure 6:
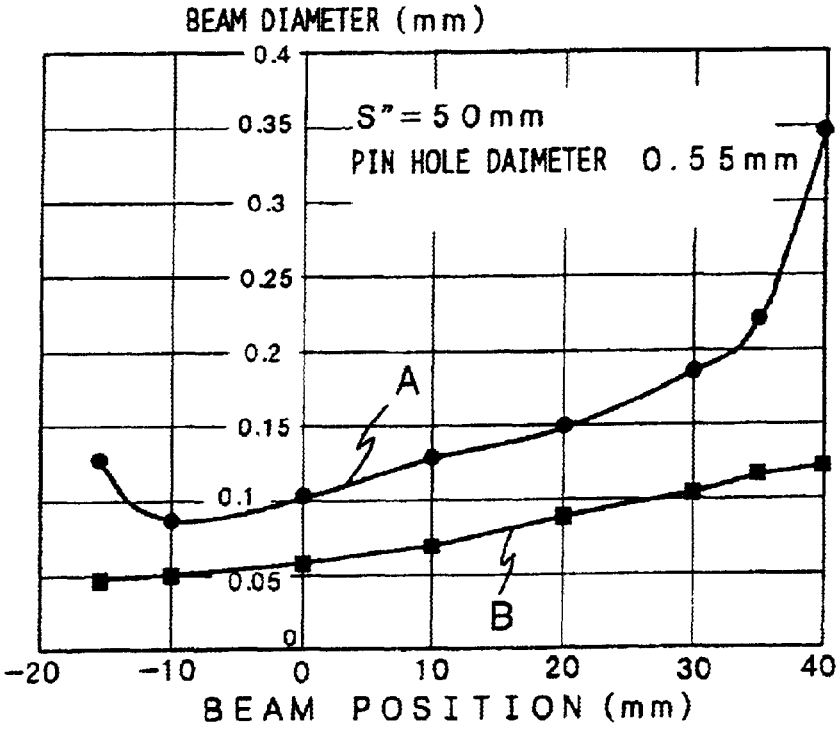
FIG. 6 is a graph showing the beam diameter as a function of the beam position, measured in the laser sensor of FIG. 1, under the conditions that s"=50 mm and that the pin hole diameter is 0.55 mm.

In the next experiment, the same laser source 1 and the condenser lenses 2 are used. But the distance between them are adjusted so that a focus is formed at a position distant 50 mm from the condenser lens 2 in the back side of the condenser lens 2. Similarly to the former experiment, a pin hole plate is disposed at a position distant 0.5 mm from the condenser lens 2 in the back side of the condenser lens. Similar measurements are is carried out for different pin hole diameters. The result was good, similarly to that of the former experiment. A small diameter beam having a constant diameter can be obtained in a long section of the beam, when the pin hole diameter is 0.4 to 0.7 mm, similarly to the first experiment. However, the length of a constant beam diameter section, where a constant diameter beam can be obtained, in other words, where the beam diameter is not more than three times of the minimum diameter, decreases to about scant 50 mm. FIG. 6 shows the data of measurement of experiment similar to the former experiment, carried out for a pin hole having a diameter of 0.55 mm, which is the center value of range of the pin hole diameter 0.4 to 0.7 mm. We analyzed the reason why the section, where the beam diameter is not more than three times of the minimum diameter, decreases to about scant 50 mm, and identified the reason. We found that it relates to the position of the image of the light source. As shown in FIGS. 2 to 4, when the distance between the image point and the condenser lens, more precisely, the distance (s") between the image point and the second principal point is 100 mm, the section, where the beam diameter is substantially constant, (in other words, the section, where the beam diameter is not more than three times of the minimum beam diameter), is about 100 mm. On the other hand, when the distance (s") is 50 mm, the section is about 50 mm. It can be seen that when a required length of the section, where the beam diameter is substantially constant, is $\Delta z_0$, the distance (s") shall be designed so that $s'' \geqq \Delta z_0$.

Figure 7:
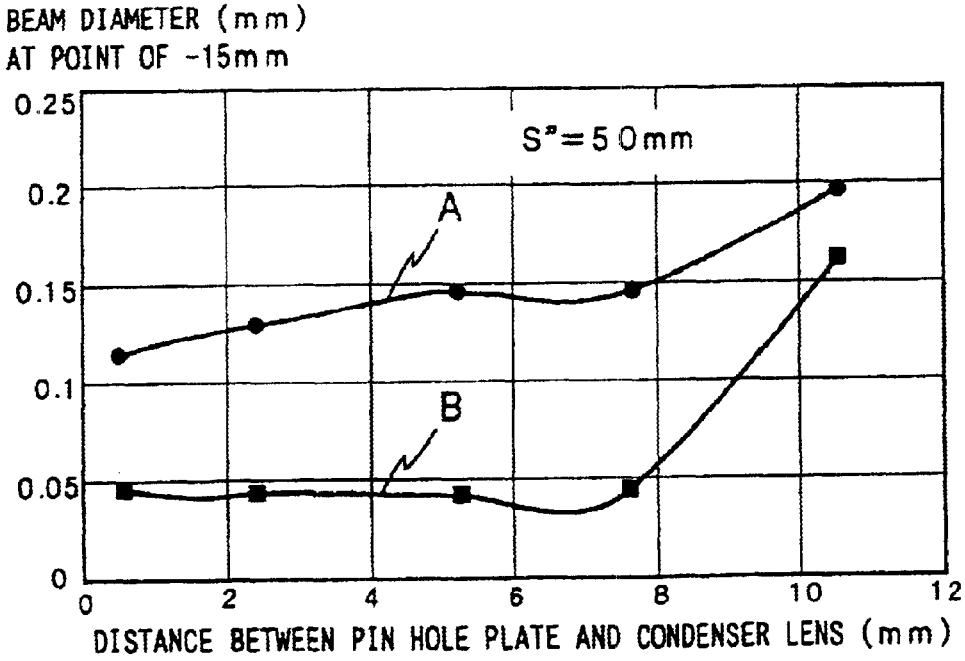
FIG. 7 is a graph showing the beam diameter as a function of the position of the pin hole plate, measured in the laser sensor of FIG. 1, under the condition that s"=50 mm.

In the next experiment, the effect of the position of the pin hole plate 3 is investigated. The constitution of the laser sensor is substantially identical to the former experiments. At first, the image position (s") of the light source is set to be 50 mm. Changing only the position of the pin hole plate from 0.5 to 10.5, and 20.5 mm from the condenser lens, the beam diameter is measured. And it is found that the bean diameter at the side of the condenser lens of the imaging point (s"=50 mm) increases remarkably, when the pin hole plate is far away from the condenser lens. FIG. 7 is a graph showing the beam diameter at a point distant 15 mm from the imaging point towards the condenser lens side, namely at a point of −15 mm, as a function of the position of the pin hole plate. Both of the 13.5% intensity beam diameter A and the 50% intensity beam diameter B are shown in it. It is apparent from the graph that separation of over 10 mm (=s"/5) of the pin hole plate from the condenser lens is not preferable, because the beam diameter rapidly increases.

Figure 8:
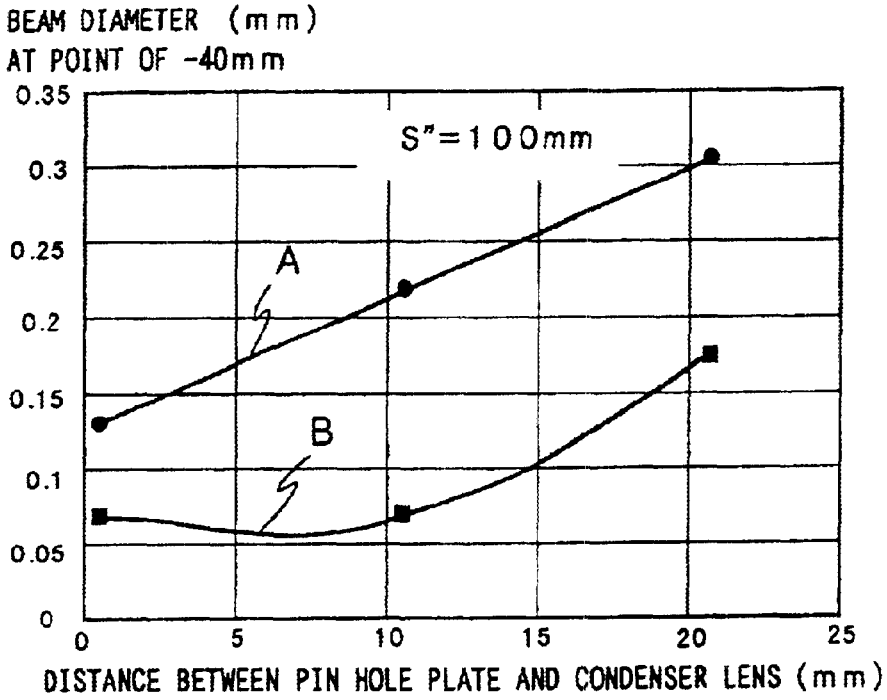
FIG. 8 is a graph showing the beam diameter as a function of the position of the pin hole plate, measured in the laser sensor of FIG. 1, under the condition that s"=100 mm.

In the next experiment, the image position of the light source is set to be s"=100 mm, and the effect of the position of the pin hole plate is investigated, similarly. FIG. 8 is a graph showing the beam diameter at a position distant 40 mm towards the condenser lens, namely at a position of −40 mm, as a function of the pin hole plate position. And it is found: the nearer to the condenser lens the pin hole plate is disposed, the smaller the beam diameter is, where the beam diameter is defined in terms of the 13.5% intensity diameter A. On the other hand, when the pin hole plate is far away from the condenser lens, the beam diameter increases, correspondingly. By the way, as to the beam diameter defined in terms of the 50% intensity beam diameter B, there is a minimum at the position of about 10 mm (=s"/10), and it increases remarkably at a section near to the position of 20 mm (=s"/5). Thus, it can be concluded that it is preferable that the position of the pin hole plate is smaller than s"/5.

In this way, the inventor of the present invention found that a small diameter light beam having a constant diameter over a section longer than 100 mm, such a laser beam is required as a laser sensor, can be obtained, by disposing a pin hole plate having a pin hole of a suitable diameter, at a suitable position. Further, the inventor investigated and found that a small diameter beam having a constant beam diameter in a long range can be obtained, irrespective to the focal length of the condenser lens, when a pin hole plate is disposed in the light beam in the vicinity of the condenser lens at the back side thereof, also when the light beam, is not a parallel beam and is a converging beam. The inventor also found that it becomes possible to use a plastics lens as a condenser lens.

Figure 12:
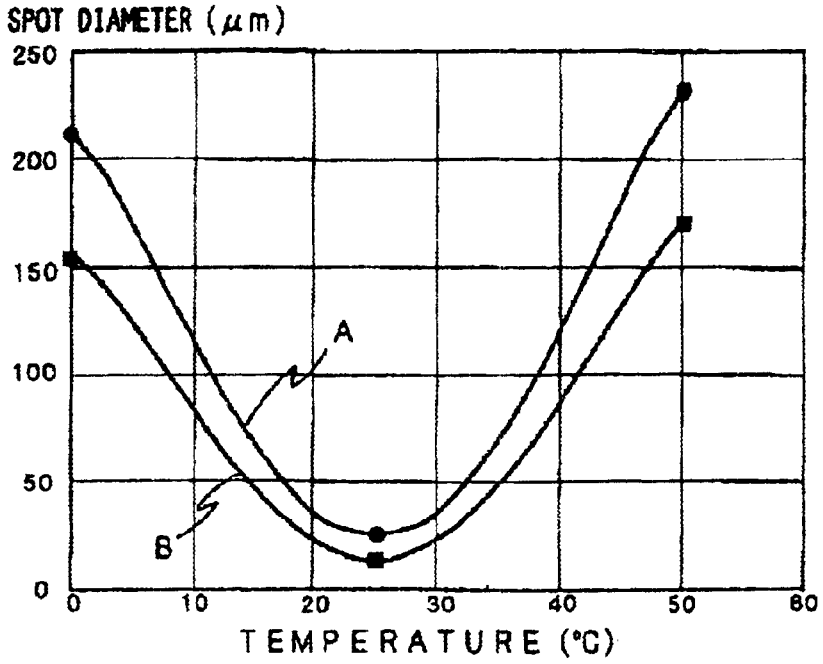
FIG. 12 PRIOR ART
FIG. 12 is a graph showing the spot diameter as a function of the temperature, measured in a laser sensor in the prior art, which uses a plastics aspherical lens.
Figure 13:
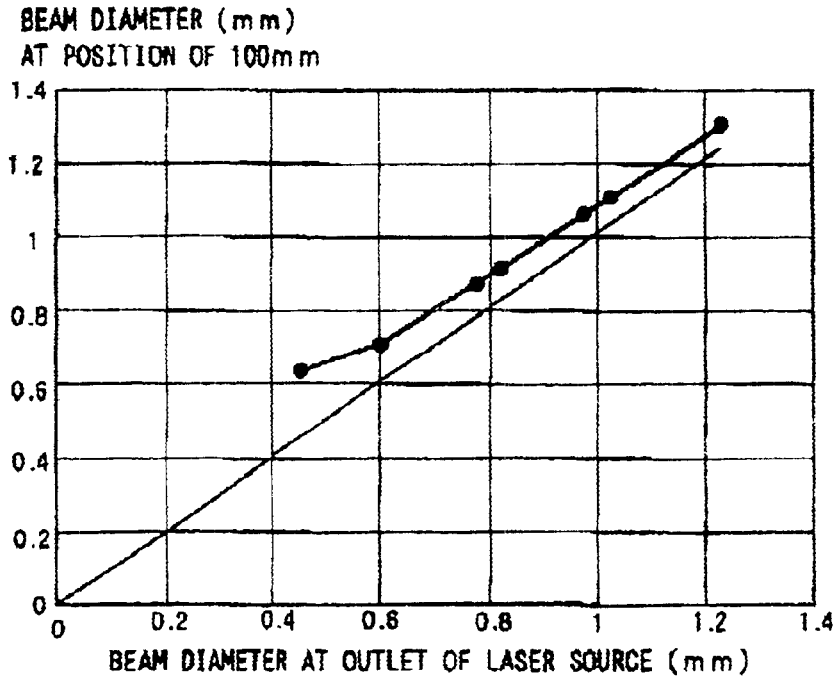
FIG. 13 PRIOR ART
FIG. 13 is a graph showing the beam diameter at a position of 100 mm from a conventional parallel laser beam generating gas laser source as a function of the beam diameter at the outlet of the laser source.
Figure 14:
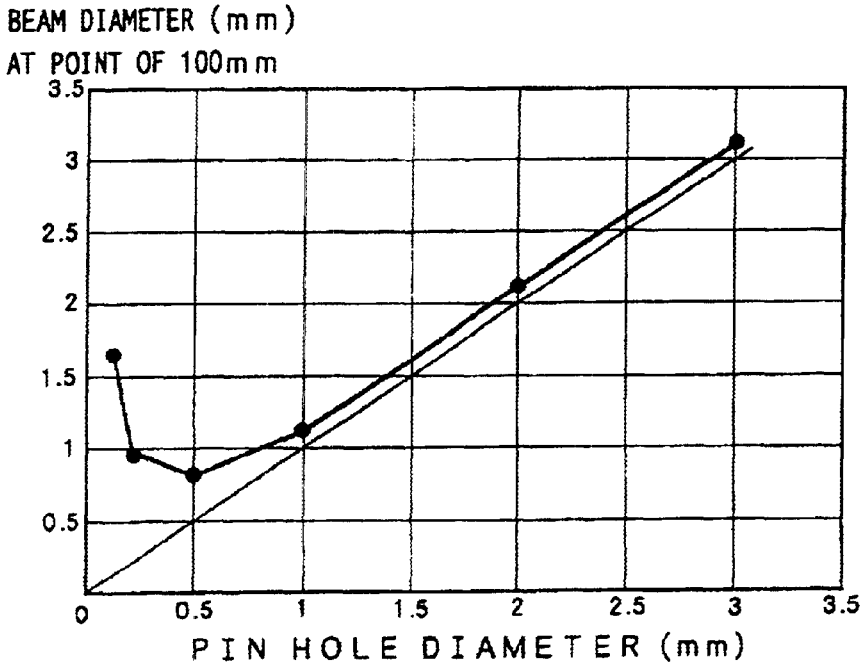
FIG. 14 PRIOR ART
FIG. 14 is a graph showing the beam diameter as a function of the pin hole diameter, measured in a laser sensor in the prior art, in which a pin hole is disposed in the parallel laser beam.
Figure 15:
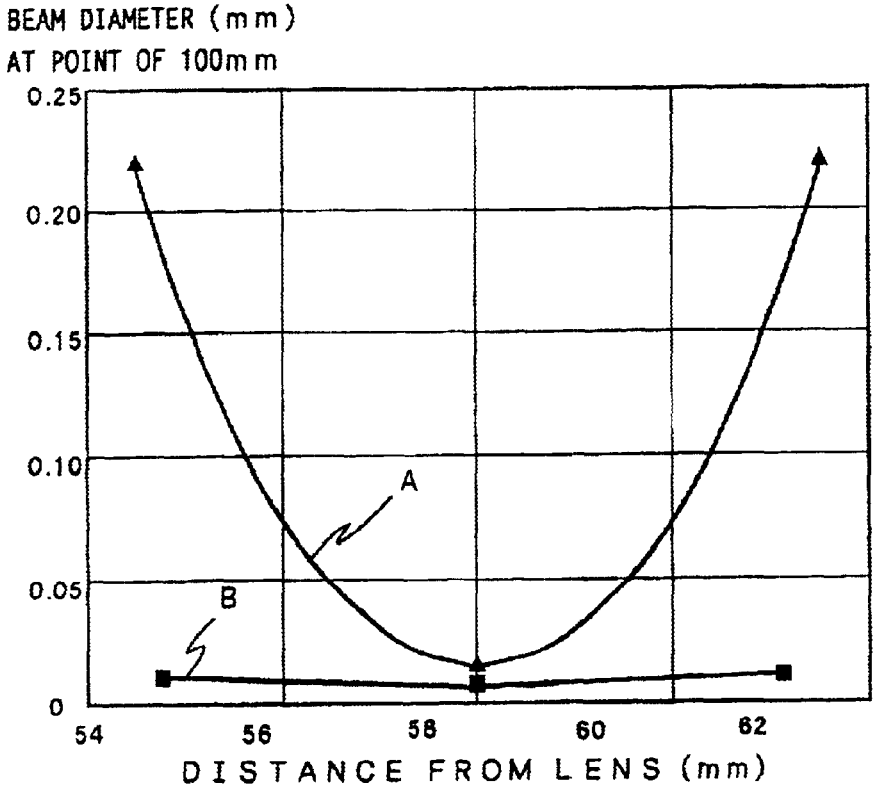
FIG. 15 PRIOR ART
FIG. 15 is a graph showing the beam diameter as a function of the distance from the lens, measured in a converging beam type laser sensor in the prior art.

In a conventional measuring apparatus using a laser beam, a plastics lens can not be used, because the refraction index of a plastics, for example, acrylic resin, decreases at a speed of about ten times of that of glass, when the temperature raises, as shown in Table 1. When the refractive index decreases, the focal length increases. Thus, the imaging position changes. And the diameter of an imaging spot strongly changes with the temperature, as shown in FIG. 12, which is a graph showing the relation between the diameter of an image spot as a function of the temperature. In FIG. 12, the beam diameters, defined in terms of the 13.5% intensity beam diameter A and the 50% intensity beam diameter B are shown.

TABLE 1

| | Wave length | | |
|---|---|---|---|
| Temperature | 780 nm | 655 nm | 588 nm |
| 0° C. | 1.489 | 1.491 | 1.495 |
| 25° C. | 1.486 | 1.488 | 1.492 |
| 50° C. | 1.483 | 1.485 | 1.489 |

An aspherical lens made from acrylic resin having a focal length of 10 mm is prepared as a condenser lens. The laser sensor having the identical constitution as that used in the former experiments is used. The wave length of the laser source is 655 nm, which is identical to that used in the former experiments. The laser source is aligned on the optical axis of the laser sensor, and positions of the laser source and the condenser lens are adjusted so that an image of the laser source is formed at a point distant 50 mm from the condenser lens in the back side thereof.

Figure 9:
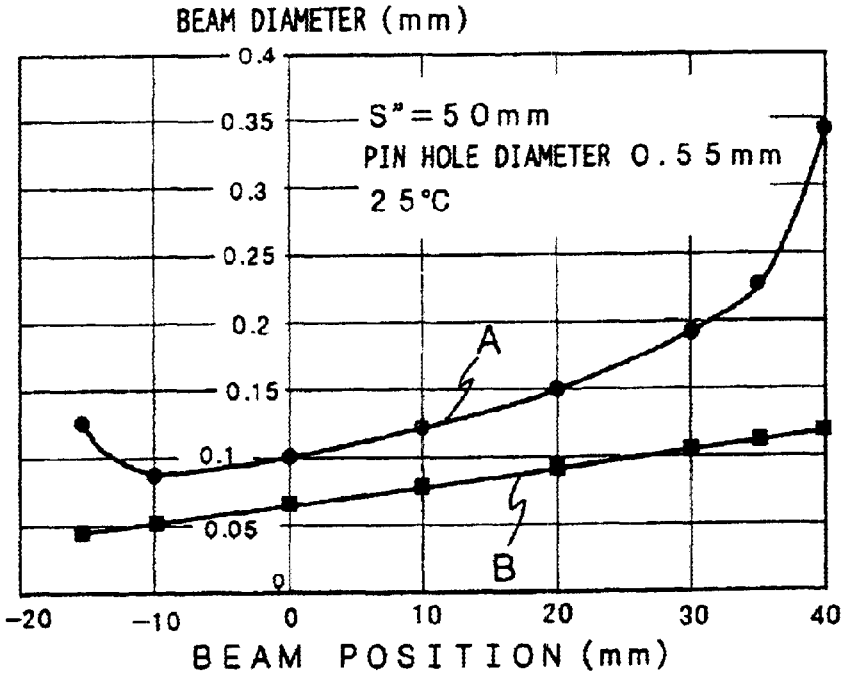
FIG. 9 is a graph showing the beam diameter as a function of the beam position, measured in the laser sensor of FIG. 1, under the conditions that the condenser lens is a plastics aspherical lens, that the pin hole diameter is 0.55 mm, and that the temperature is a room temperature.

Then a pin hole plate, having a pin hole of 0.55 mm diameter, is set at a position distant 0.5 mm from the condenser lens in the back side thereof (opposite side to the laser source). And the beam diameters, defined in terms of the 13.5% intensity beam diameter A and the 50% intensity beam diameter B, are measured at the temperature of 25° C., and the result is shown in FIG. 9. It is apparent from FIG. 9 that the result is substantially identical to the result using a glass condenser lens.

Figure 10:
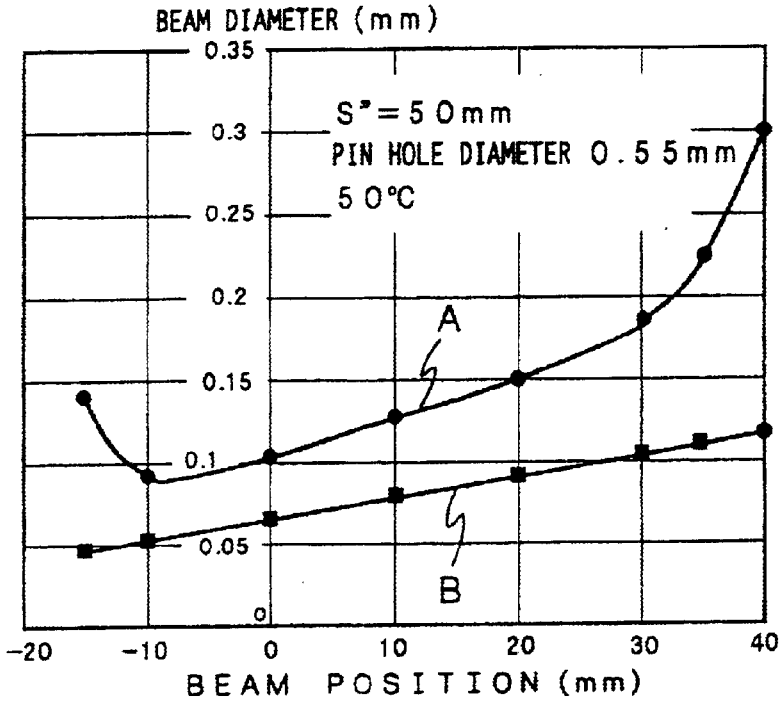
FIG. 10 is a graph showing the beam diameter as a function of the beam position, measured in the laser sensor of FIG. 1, under the conditions that the condenser lens is a plastics aspherical lens, that the pin hole diameter is 0.55 mm, and that the temperature is 50° C.
Figure 11:
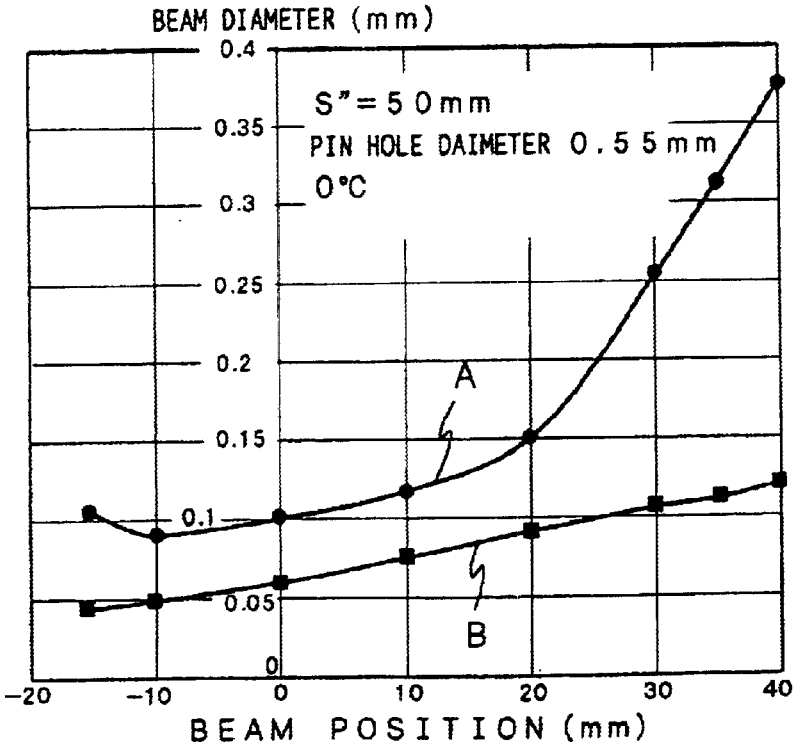
FIG. 11 is a graph showing the beam diameter as a function of the beam position, measured in the laser sensor of FIG. 1, under the conditions that the condenser lens is a plastics aspherical lens, that the pin hole diameter is 0.55 mm, and that the temperature is 0° C.

Further, the beam diameter is measured under the identical condition, but the temperature of the whole system is 50° C. The result is shown in FIG. 10. The wave length of the laser is 660 nm. Further the beam diameter is measured under the identical condition, but the temperature of the whole system is 0° C. The result is shown in FIG. 11. The wave length of the laser source is 650 nm, in this case. It is apparent from FIGS. 9 to 11 that the effect of the temperature is small, excepting that the 13.5% intensity beam diameter A at 0° C. tends to rapidly increase, when the position of the beam detecting is over 20 mm. Thus it is possible to overcome sufficiently the change due to the temperature, even when a plastics lens is used.

That the reason of this fact is quite likely that beam diameter is defined by the diffraction of the pin hole, because the pin hole is disposed in the converging beam at a position near to the condenser lens in the back side of the condenser lens. Further, even when the laser source is a semiconductor laser, the wave length change of the laser is within ±5 nm (+0.8%) against the temperature change of ±25° C., and it is known that the effect of the diffraction due to a circular aperture depends on the wave length as a first order function of the wave length. Thus, the effect of the diffraction hardly depends on the temperature. As a result, the change of the converging effect of the plastics lens due to the temperature change is shielded by the diffraction effect, when a pin hole plate is disposed at the back side of the condenser lens. Consequently, the change of the converging effect of the plastics lens due to the temperature hardly appears.

In the aforementioned example, the plastics lens is made from acrylic resin. However, the material for making the lens is not limited to this material. Material other than acrylic resin, for example, poly-carbonate or poly-olefin can be used for making the lens. Aspherical lens can be fabricated from these plastics, using an injection molding. In such a case, lenses with a higher preciseness can be fabricated easily with high productivity.

According to the present invention, a small diameter beam having a diameter of 0.1 mm order can be obtained in a range over 100 mm. Such a laser sensor allows to measure precisely, for example, the particle size of a flying particle, which has a diameter of some 10 micro meters. Consequently, it is advantageous to use the laser sensor according to the present invention for measuring the size of particles in the air or in liquid, or for detecting whether such flying particles exist or not.

Further, according to the present invention, it is possible to use the laser sensor, almost without being affected by the effect of temperature, using a plastics lens as a condenser lens. A precise aspherical lens can be fabricated very economically by injection mold method. It is possible to use a plastics lens in a precise measuring apparatus, without using an auto-focusing mechanism.

Although preferred example have been described in some detail it is to be understood that certain changes can be made by those skilled in the art without departing from the spirit and scope of the invention as defined by the appended claims.

What is claimed is:

1. A laser sensor comprising:

a laser source;

a condenser lens for converging the light from said laser source;

a pin hole plate disposed adjacent to said condenser lens in the opposite side to said laser source, said pin hole plate having a pin hole positioned in the converging beam converged by said condenser lens; and a light detecting portion disposed so as to face to the converging beam passed said pin hole, wherein a diameter of said pin hole is 0.4 to 0.7 mm, and wherein said pin hole plate is disposed at the back side of said condenser lens, and the distance between said pin hole plate and the back surface of said condenser lens is less than ⅕ of the distance (s") between an image point of said laser source by said condenser lens and a second principal point of said condenser lens.

2. A laser sensor according to claim 1, wherein said condenser lens is a plastic aspherical lens.

3. A laser sensor according to claim 1, wherein the wavelength of the light of said laser source is less than 800 nm.

4. A laser sensor according to claim 1, wherein said laser source is a semiconductor laser.

5. A laser sensor comprising:

a laser source;

a condenser lens for converging the light from said laser source;

a pin hole plate disposed adjacent to said condenser lens in the opposite side to said laser source, said pin hole plate having a pin hole positioned in the converging beam converged by said condenser lens; and a light detecting portion disposed so as to face to the converging beam passed said pin hole, wherein a diameter of said pin hole is 0.4 to 0.7 mm, and wherein the position of said laser source and a focal length of said condenser lens are designed so that the distance (s") between an image point of said laser source by said condenser lens and a second principal point of said condenser lens is a distance $\geqq \Delta z_0$, wherein $z_0$ is a distance wherein a predetermined beam diameter is maintained.

6. A laser sensor according to claim 5, wherein said condenser lens is a plastic aspherical lens.

7. A laser sensor according to claim 5, wherein the wavelength of the light of said laser source is less than 800 nm.

8. A laser sensor according to claim 5, wherein said laser source is a semiconductor laser.

* * * * *